US005419063A

United States Patent [19]

Lane

[11] Patent Number: 5,419,063

[45] Date of Patent: May 30, 1995

[54] DISPLAY BOARD

[75] Inventor: Cindy L. Lane, Houston, Tex.

[73] Assignee: Cyns' Group, Inc., Houston, Tex.

[21] Appl. No.: 56,646

[22] Filed: May 3, 1993

[51] Int. Cl.[6] ..... A47G 1/06; A45C 11/04

[52] U.S. Cl. ..... 40/152; 40/156; 206/6.1

[58] Field of Search ..... 40/152, 152.1, 154, 40/156; 206/6.1, 478

[56] References Cited

U.S. PATENT DOCUMENTS

| | | | |
|---|---|---|---|
| 3,186,117 | 6/1965 | Detje | 40/156 |
| 4,905,821 | 3/1990 | Corbett | 206/6.1 X |
| 5,168,986 | 12/1992 | Stenhouse | 206/6.1 |
| 5,207,019 | 5/1993 | Massey et al. | 40/156 X |
| 5,253,750 | 10/1993 | Keffer | 206/6.1 |
| 5,273,154 | 12/1993 | Braun | 206/6.1 X |

FOREIGN PATENT DOCUMENTS

| | | | |
|---|---|---|---|
| 3919517 | 7/1990 | Germany | 206/6.1 |
| 1551569 | 8/1979 | United Kingdom | 206/6.1 |

*Primary Examiner*—Edward K. Look
*Assistant Examiner*—Hoang Nguyen
*Attorney, Agent, or Firm*—John R. Casperson

[57] ABSTRACT

A display device for objects having protruding wires is disclosed. The device includes a panel formed from self sealing foam, preferably a polyethylene foam. Preferably, the panel is retained in position by a frame such as a picture frame. In a preferred embodiment, the front side of the panel is painted. The display device is especially well suited for storing and displaying pierced earrings in addition to other items. The earring post can be inserted into the foam panel without removal of the backer.

20 Claims, 2 Drawing Sheets

DISPLAY BOARD

BACKGROUND OF THE INVENTION

In one aspect, this invention relates to a display board for objects. In another aspect, this invention relates to a method for displaying objects. In yet another aspect, this invention relates to a method for fabricating a display board for objects.

Certain types of objects are more difficult to store than others. Earrings and other items of jewelry are small and easily lost if not secured. Also, earrings are susceptible to becoming separated if not secured. Consumer jewelry boxes keep the earrings in compartments to help solve this problem—but the small items tend to get mixed up between compartments when searches for specific items are made. A storage device to position small items such as earring in such a manner that they stay together would be very desirable.

Further, jewelry boxes designed for consumers fail to display earrings and other jewelry items prominently in a manner to case in item selection. Jewelry stores solve the problem by displaying the items on specially designed stands or in individual boxes. Consumer jewelry boxes do not have a sufficient number of compartments to separately display many earring pairs. The result is that several pairs are often stored in the same compartment. A storage device which stores small objects such as earrings in such a way that they stay segregated from other pairs would be very desirable.

Still further, consumer jewelry boxes do not attractively display their contents. The aesthetic qualities of many jewelry items are lost in the bottom of the box. A method for storing jewelry items such as earrings so that their aesthetic qualities could be better appreciated would be clearly desirable.

Earring sunflowers and ladders and various holders have been proposed for earring storage. But before pierced earrings can be placed on such devices, the back has to be removed and the earring reassembled in position. This creates opportunity for loss of the backing. A storage device that does not require disassembly and reassembly of the earring would be very desirable as well.

OBJECTS OF THE INVENTION

It is an object of this invention to provide a storage and display device well adapted for the storage and display of small articles, such as earrings.

It is another object of this invention to provide a storage and display device for small objects such as earrings which keeps them reliably positioned where they were left so that they do not become lost or misplaced.

It is another object of this invention to provide a storage and display device for small objects which displays them for viewing in an attractive manner for selection and for showing them off.

It is another object of this invention to provide a storage and display device for pierced earrings which accomplishes the forgoing objective without requiring disassembly of the earring for storage purposes.

SUMMARY OF THE INVENTION

In one embodiment of the invention, there is provided a display device for objects such as those having protruding wire ends. It is well adapted for displaying objects such as pierced earrings, fishing lures and clothing and hat pins, but it is especially well suited for pierced earrings. The display device is made from a polymerized foam panel. The front side of the foam panel is uncovered and accessible to users. A frame extends around the periphery of the foam panel. The frame provides structural integrity and aesthetic qualities. A means is associated with the backside of the panel for positioning the panel in a substantially vertical orientation. This permits the display device to be placed in a convenient location, such as on a tabletop or wall. When the panel is formed from polyethylene foam, it can be formed with a rough cut front surface which is attractive when painted and highly suitable for positioning on a dressing table or the like.

In another embodiment of the invention, there is provided a method for releasably positioning an item having at least one protruding wire fastener for display. The method comprises pressing protruding wire fastener into a panel of self-sealing polyethylene foam. The preferred foam has a polyethylene content in the range of 77 to 100 weight percent and a density in the range of 0.01 to 0.06 g/cc. The protruding wire is pressed into the foam a sufficient depth to fasten the item to said panel. The use of polyethylene foam provides several distinct advantages. First, the polyethylene foam heals when the fastener is withdrawn, so it does not wear out or suffer appear degradation during ordinary use. Secondly, the polyethylene foam is firmer than styrofoam but softer than cork, so that it is soft enough to accept blunt wire (of the kind used in pierced earrings) inserted under hand pressure but yet firm enough to firmly retain lightweight objects such as earrings which have been fastened to it. Thirdly, polyethylene foam has high resilience and a high limit of elasticity, so that it won't permanently dent or deform under ordinary conditions of use, and will retain an attractive appearance indefinitely.

In yet another embodiment of the invention, there is provided a process for forming a display device for items having protruding wire ends. The process comprises cutting a polyethylene plastic foam panel to a size to be closely received by a picture frame. The picture frame must have a sufficient depth to accommodate the foam panel. One surface of the polyethylene foam panel is painted. Preferably, a paint substance is used which provides the surface with a textured fabric-like appearance. The panel is positioned in the frame with the painted surface facing forward. A backer for the panel is attached to the frame to support the back side of said panel to prevent the panel from bending and possibly popping out of the frame when objects are attached to the display panel during use.

DETAILED DESCRIPTION OF THE INVENTION

Figure 1:
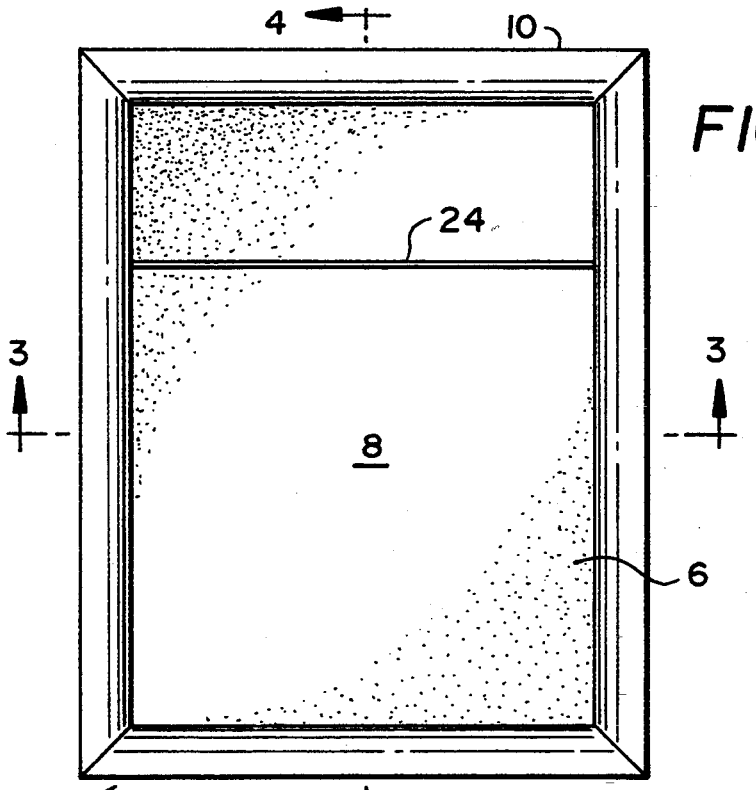
FIG. 1 is a pictorial representation of the front side of a display panel which embodies certain features of the present invention.
Figure 3:
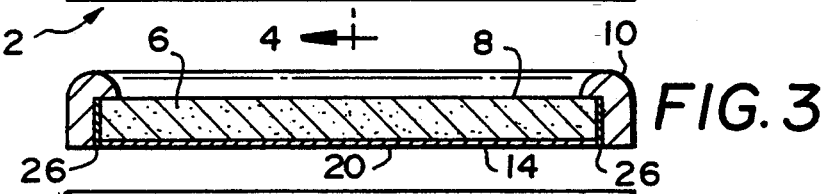
FIG. 3 is a cross-sectional view of the display panel taken along lines 3—3 of FIG. 1.
Figure 2:
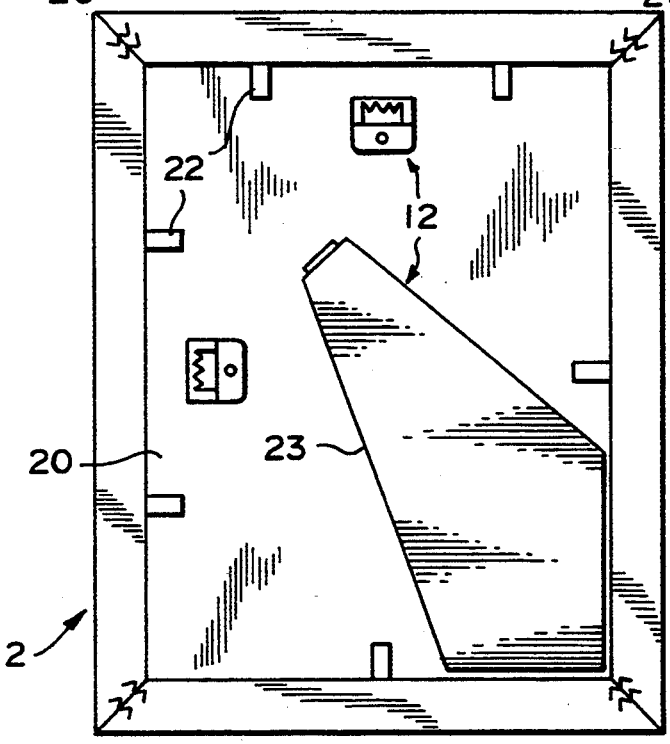
FIG. 2 is a pictorial representation of the back side of the display panel shown in FIG. 1.
Figure 4:
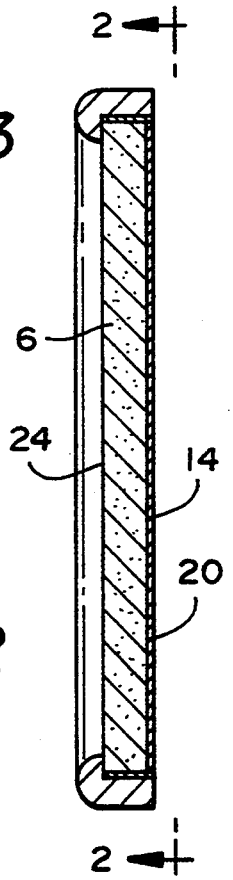
FIG. 4 is a cross-sectional view of the display panel taken along lines 4—4 of FIG. 1.
Figure 5:
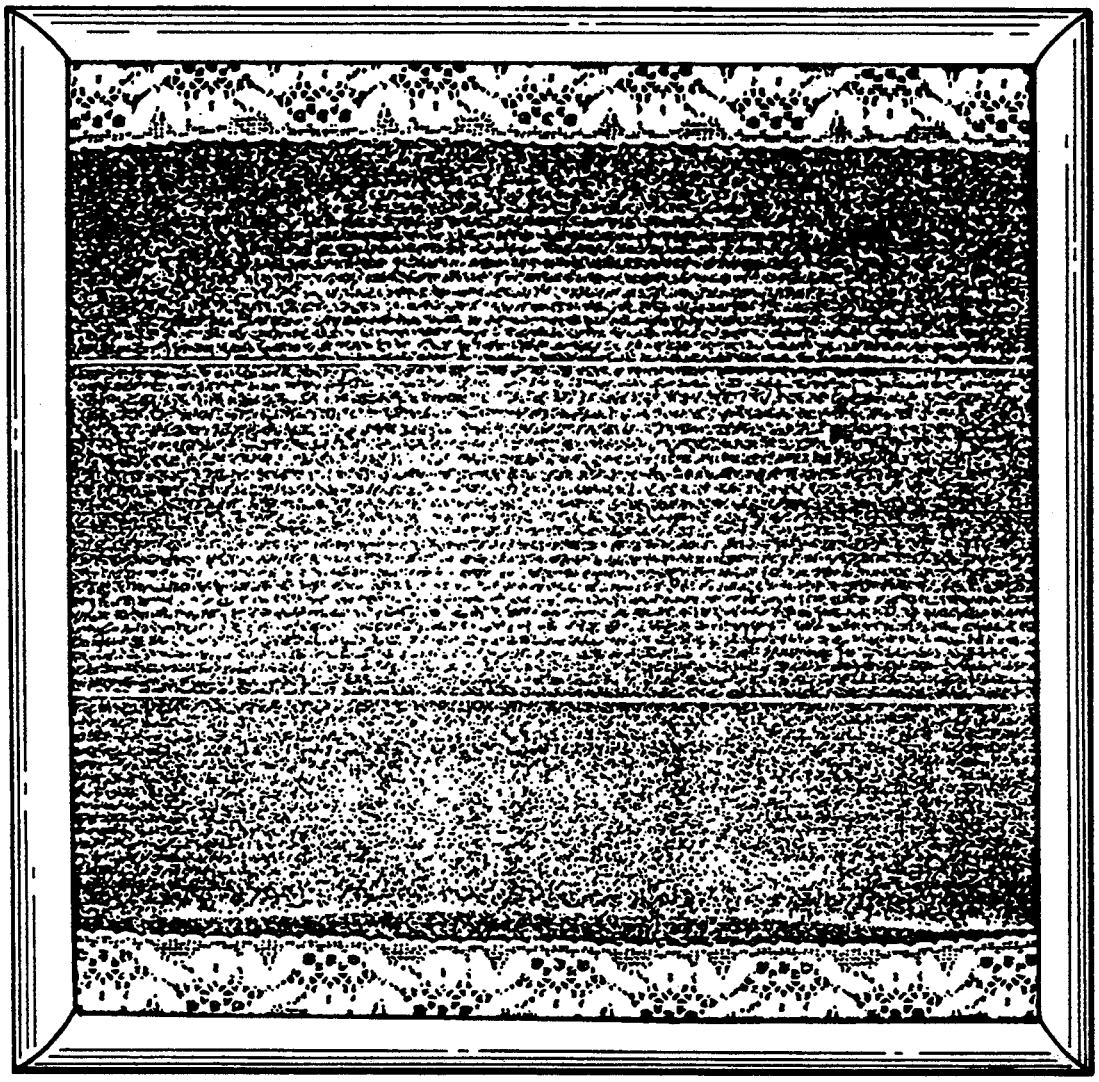
FIG. 5 is a plan view of a preferred embodiment of the invention.

In one embodiment of the invention, there is provided a display device 2 for objects such as those having protruding wire ends. The display device 2 is made from a polymerized team panel 6. The front side 8 of the foam panel is uncovered and accessible to users. A frame 10 extends around the periphery of said polymerized foam panel 6. The frame 10 provides structural integrity and aesthetic qualities. A means 12 is associated with the backside 14 of the panel 6 for positioning the panel in a substantially vertical orientation. This permits the display device 2 to be placed in a convenient location, such as on a tabletop or wall. When the panel 6 is formed from polyethylene foam, it can be formed with a rough front surface 8 which is attractive when painted and makes the device highly suitable for positioning on a dressing table or the like.

The display device 2 is well adapted for displaying objects such as pierced earrings, fishing lures and clothing and hat pins, but it is especially well suited for pierced earrings. Pierced earrings have a protruding wire post. On most pierced earrings, the post is formed from wire having a diameter in the range of 0.2 to 2 mm, usually in the range of 0.4 to 0.8 mm. The posts of pierced earrings are blunt to avoid injuring the wearers of such earrings.

It is important when the display device 2 is to be used for pierced earrings that the foam panel be soft enough to be penetrated by the earring posts under hand pressure. It is also important that the panel be self healing, that is, it does not visibly scar when the stored objects are removed. It is also important that the panel be resilient enough and have a sufficiently high limit of elasticity so that it does not permanently deform when in use. Suitable panels are those which will not permanently deform under moderate finger pressure. Conventional polystyrene, such as that used for disposable food and beverage containers, is not suitable.

One material which has been found to be highly suitable for use as the panel is expanded polyethylene, which can be described as polyethylene foam. It is a very lightweight material, typically having a density in the range of 0.01 g/cc to 0.06 g/cc. A suitable polyethylene foam is available from Dow Chemical Company. It has a polyethylene content in the range of 77 to 100 wt. %, a blowing agent content in the range of 0 to 20 wt. %, and an amount of glycerol monostearate in the range of 0 to 2 wt. %. The blowing agent presently used is chlorodifluoroethane. This material can be cut to shape with a knife or heated cutting device such as a hot wire. It can be attractively painted with a variety of paints. Either the glazed surfaces resulting from the molding process or unglazed surfaces resulting from cutting the panel to size can be painted. The cut surfaces exhibit an attractive textured, rough, fabric-like appearance after painting. Surprisingly, the paint is self healing as well, so a display device formed from painted expanded polyethylene shows little wear under normal conditions of use.

In a preferred embodiment of the invention, the frame 10 is a picture frame. It is differentiated from many picture frames by its depth, which must be sufficient to accommodate the foam panel. Generally, the panel 6 will have a thickness in the range of about 5 mm to about 30 mm. Usually, the thickness will be in the range of about 8 to about 25 mm. In a preferred embodiment, the panel has a thickness in the range of 10 to 15 mm because a panel having a thickness closely encompassed by these limits has been tested with good results. The frame preferably forms a box-like receptacle open at the rear for receiving the panel from the rear of the frame. The receptacle has a depth sufficient to accommodate the foam panel. Optionally a backboard is attached to the frame as described below. The display device can be any desired length and width, but will usually be fairly small for convenience. Generally speaking, the display device will have a length in the range of 150 to 500 mm and a width in the range of 150 to 500 mm.

The display device will usually include a backboard 20 which is attached to the frame 10 by suitable fastening means, such as fasteners 22. The backboard can be formed from most any rigid material, but will generally be formed from paper laminate. It should have good resistance to bending to cover and provide support to the backside of the panel during use. The means 12 will generally be fastened to the backside of the backboard 20. One suitable means 12 is formed by an easel means 23. The easel means 23 can be formed by a hinged leg as is well known.

In a further embodiment of the invention, at least one elastic band 24 is provided on the display device 2 which crosses the front side 8 of the panel 6. Objects such as glasses or hair ornaments can be retained under the band 24. Various types of clip earrings can also be fastened to the panel 6 by the at least one band 24. Cufflinks and/or tie tacks can also be fastened to the panel 6 by the at least one band 24 if desired. Preferably, for ease of fabrication, the band 24 encircles the panel 6. More preferably, stiffening strips 26 are positioned one on each edge of the panel between the edge of the panel and the at least one elastic band to prevent deformation of the panel.

While certain preferred embodiments of the invention have been described hereinabove, the invention is not to be construed as so limited, except to the extent such limitations are found in the claims.

What is claimed is:

1. A display device for objects having protruding wire ends, said display device comprising:

(a) a polymerized pierceable foam panel having a flat front surface and a back surface with the front surface being uncovered so as to be exposed and accessible;

(b) a frame extending around the periphery of said polymerized foam panel; and (c) means associated with the back surface of said panel for positioning said panel in a substantially vertical orientation.

2. A display device as in claim 1 wherein the frame is a picture frame and the polymerized foam panel comprises a self healing foam.

3. A display device as in claim 2 further comprising a backboard mounted to said frame in covering relationship with said panel.

4. A display device as in claim 3 wherein the polymerized foam panel is readily pierceable by blunt wire having a diameter in the range of from about 0.4 mm to about 0.8 mm using hand pressure.

5. A display device as in claim 4 wherein the polymerized foam panel has sufficiently high limits of elasticity so that it doesn't permanently deform under moderate finger pressure.

6. A display device as in claim 5 wherein the foam panel has a thickness in the range of from about 5 to about 30 mm.

7. A display device as in claim 6 wherein the foam panel has a thickness in the range of from about 8 to about 25 mm.

8. A display device as in claim 7 wherein the foam panel comprises an expanded polyethylene which has a density in the range of 0.01 to 0.06 g/cc.

9. A display device as in claim 8 wherein the foam panel comprising an expanded polyethylene has been expanded with a chlorodifluoroethane and contains in the range of 0–2 wt. % glycerol monostearate, 0–20 wt. % chlorodifluoroethane, and 77–100 wt. % polyethylene.

10. A display device as in claim 9 wherein the panel has an unglazed rough ungrooved front surface.

11. A display device as in claim 10 further comprising a coating of paint on the front surface of the panel.

12. A display device as in claim 11 further comprising at least one elastic band crossing at least the front surface of the panel.

13. A display device as in claim 12 wherein the at least one elastic band encircles the panel and a portion of the band crosses the front surface of the panel.

14. A display device as in claim 13 further comprising a pair of stiffening strips positioned one on each edge of the panel between the panel and the at least one elastic band.

15. A display device as in claim 10 wherein the front surface of the panel is textured and has a fabric-like appearance.

16. A display device as in claim 10 wherein the frame is generally rectangular and has a length in the range of 150 to 500 mm and a width in the range of about 150 to about 500 mm and forms a generally box-like receptacle having a depth in the range of from about 5 mm to about 30 mm for receiving the panel from the rear of the frame, said display device further comprising fastening means attaching said backboard to said frame, and easel means attached to the backside of said back board for supporting the display device generally upright on a tabletop.

17. A method for releasably positioning an item having at least one protruding wire fastener for display, said method comprising pressing said protruding wire fastener into a panel of self-sealing polyethylene foam having a polyethylene content in the range of 77 to 100 weight percent and a density in the range of 0.01 to 0.06 g/cc a sufficient depth to fasten said item to said panel, wherein the panel is pierced by said protruding wire fastener.

18. A method as in claim 17 wherein said wire fastener has a diameter in the range of about 0.4 to about 0.8 mm and said item is selected from the group consisting of pierced earrings, pins, and fishing lures.

19. A method as in claim 18 wherein the panel has a thickness in the range of 5 mm to 30 mm, a length in the range of about 150 mm to about 500 mm and a width in the range of about 150 to about 500 mm.

20. A method for forming a display device for items having protruding wire ends, said method comprising:

cutting a polyethylene plastic foam panel to a size to be closely received by a picture frame having a sufficient depth to accommodate said foam panel;

painting one surface of said polyethylene foam panel with a paint substance to provide said surface with a textured fabric-like appearance;

positioning said panel in said frame with the painted surface facing forward so as to be exposed and accessible; and fastening a backer for said foam panel to said frame to support the back side of said panel.

* * * * *